US005910726A

United States Patent [19]

Koifman et al.

[11] Patent Number: 5,910,726

[45] Date of Patent: Jun. 8, 1999

[54] REFERENCE CIRCUIT AND METHOD

[75] Inventors: Vladimir Koifman, Rishon Le Zion; Yachin Afek, Kfar Saba, both of Israel

[73] Assignee: Motorola, Inc., Schaumburg, Ill.

[21] Appl. No.: 08/911,239

[22] Filed: Aug. 15, 1997

[51] Int. Cl.[6] ..... G05F 3/20

[52] U.S. Cl. ..... 323/315; 323/907; 323/314

[58] Field of Search ..... 323/313, 314, 323/315, 316, 907; 327/513, 535, 537, 539, 541, 542, 543

[56] References Cited

U.S. PATENT DOCUMENTS

| | | | |
|---|---|---|---|
| 4,375,595 | 3/1983 | Ulmer et al. | 323/314 X |
| 5,424,628 | 6/1995 | Nguyen | 323/314 |
| 5,479,092 | 12/1995 | Pigott et al. | 323/313 |

OTHER PUBLICATIONS

Motorola Technical Developments, "CMOS Bandgap circuit" by Andreas Rusznyak, vol. 30, pp. 101–103, Mar. 1997.

IEEE Journal of solid state circuits "A programmable CMOS dual channel interface processor for telecommunications applications", Bhupendra K. Ahuja, Paul R. Gray, Wayne M. Baxter and Gregory T. Uehara, vol. SC19, No. 6, Dec. 1984.

Song, B.S., Gray P.R. A precision curvature–compensated CMOS bandgap reference, IEEE Journal of solid state circuits, vol. SC–18, No. 6, Dec. 1983, pp. 634–643.

Horowitz P. Hill W., "The art of electronics", second edition, Cambridge University Press, chapter 6.15, Bandgap ($V_{Be}$) reference, pp. 335–341, 1989.

*Primary Examiner*—Peter S. Wong
*Assistant Examiner*—Y. J. Han

[57] ABSTRACT

A reference circuit (200') has bipolar transistors (216, 226) providing a voltage difference ΔV of base-emitter voltages $|V_{BE}|$ and has resistors (210/$R_1$, 220/$R_2$) for adding a current $I_{R1}$ resulting from ΔV and a current $I_{R2}$ resulting from of base-emitter voltage $|V_{BE}|$ of one bipolar transistor (216 or 226) so that a resulting temperature coefficient $TC_{TOTAL}$ of said currents $I_{R1}$ and $I_{R2}$ is compensated. The circuit (200') has voltage transfer units (260, 270) which transfer ΔV to the resistors (210/$R_1$, 220/$R_2$) so that the resistors (210/$R_1$, 220/$R_2$) do not substantially load the bipolar transistors (216, 226). The voltage transfer units (260, 270) have input stages with n-channel FETs. A control unit (241) which is coupled to the bipolar transistors (216, 226) adjusts input voltages ($|V_{CE}|$) at the voltage transfer units (260, 270) to temperature changes, so that the n-channel FETs operate in an active region. The control unit (241) has a voltage source (290) providing a voltage $V_{DS\ REF}$ which is similary temperature and process depending as a drain-source voltage of the n-FETs.

21 Claims, 3 Drawing Sheets

—PRIOR ART—

REFERENCE CIRCUIT AND METHOD

FIELD OF THE INVENTION

The present invention generally relates to electronic circuits, and more specifically to circuits providing temperature independent reference voltages.

BACKGROUND OF THE INVENTION

It is common in the electronic art to use reference voltage in connection with complex circuits and systems. Various circuits for generating reference voltages are well known, including those which employ temperature compensation so that the reference voltage is substantially independent of the temperature over a significant range.

Bandgap reference circuits are known, for example, from:

[1] Horowitz, P., Hill, W.: The art of electronics, Second Edition, Cambridge University Press, chapter 6.15: Bandgap ($V_{BE}$) reference, pages 335–341;

[2] Ahuja, B. et. al.: A programmable CMOS Dual Channel Interface Processor for Telecommunications Applications, IEEE Journal of Solid State Circuits, vol. SC-19, no. 6, December 1984;

[3] Song, B. S., Gray, P. R.: A Precision Curvature-Compensated CMOS Bandgap Reference, IEEE Journal of Solid-State Circuits, vol. SC-18, No. 6, December 1983, pages 634–643;

[4] U.S. Pat. No. 4,375,595 to Ulmer et. al.; and

[5] Ruszynak, A.: CMOS Bandgap Circuit, Motorola Technical Developments, volume 30, March 1997, published by Motorola Inc., Schaumburg, Ill. 60196, pages 101–103.

The principle used in the circuits described in above mentioned references [1] and [2], as with many other similar circuits, is based on adding two voltages whose temperature coefficients have opposite signs. One voltage is generated by a current of a given amount flowing through a diode or bipolar transistor resulting in a negative temperature coefficient and the other voltage is obtained across a resistor and has a positive temperature coefficient.

FIG. 1 is a simplified circuit diagram of reference circuit 100 known in the art. Circuit 100 receives a supply voltage between lines 101 and 102. Circuit 100 comprises resistors $R_a$, and $R_b$, operational amplifier OA, bipolar transistors $Q_1$ and $Q_2$, and current sources $I_1$ and $I_2$, coupled, for example, as illustrated in FIG. 1. A variety of publications, such as e.g., above mentioned references [1], [2], or [4], explain how circuit 100 provides substantially temperature independent voltage $V_{out}$ at line 110. Arrow 105 pointing to resistors $R_a$ and $R_b$ symbolizes spikes or other noise penetrating into circuit 100 via, e.g., a silicon substrate. Such spikes occur especially in integrated circuits which have analog portions (e.g., circuit 100) in the vicinity of digital portions. The sensitivity to accept spikes increases with the geometrical size of resistors $R_a$ and $R_b$. Also, spikes can be rectified by transistors $Q_1$ and $Q_2$ or by other, including parasitic components with pn-junctions.

The spikes are not the only problem. The trend in modern integrated circuits goes to small supply voltages, such as 0.8–0.9 volts or even less. Output voltages of e.g., 1.1 to 1.2 volts are generated by switched capacitors, which are very sensitive to spikes.

In prior art circuits, such as in circuit 100, currents $I_1$, $I_2$ flow through transistors $Q_1$ and $Q_2$ and through resistors $R_a$ and $R_b$, thus loading the transistors $Q_1$ and $Q_2$. Resistors $R_a$ and $R_b$ should have large resistance values (in e.g., megaohms) to provide necessary voltage drops. Also, they should have enough chip area to carry currents $I_1$ and $I_2$. However, chip area is expensive and causes parasitic capacities making the circuit more sensitive to the above-mentioned spikes.

Accordingly, there is on ongoing need to have reference circuits which overcome these and other deficiencies well known in the art.

DETAILED DESCRIPTION OF A PREFERRED EMBODIMENT

Figure 2:
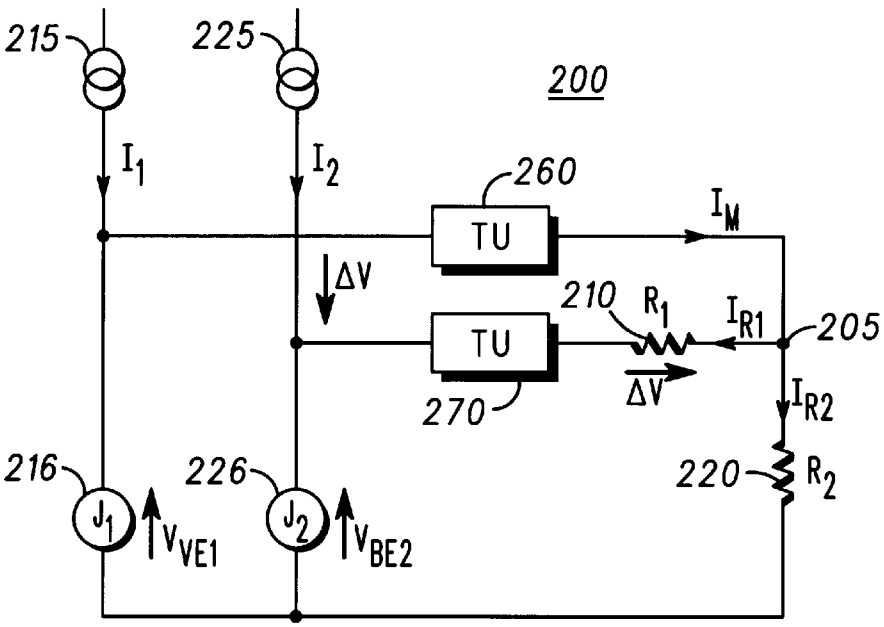
FIG. 2 is a simplified block diagram of a reference circuit according to the present invention.
Figure 1:
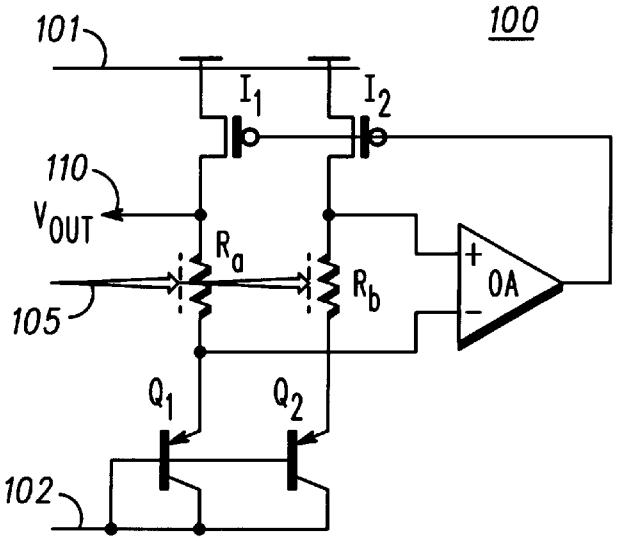
FIG. 1 is a simplified circuit diagram of a reference circuit known in the art.

FIG. 2 is a simplified block diagram of reference circuit 200 according to the present invention. Reference circuit 200 comprises current sources 215 and 225 generating currents $I_1$ and $I_2$, respectively, bipolar transistors 216 and 226, voltage transfer units 260 and 270 labeled T.U., resistor 210 with value $R_1$, resistor 220 with value $R_2$, and node 205. Arrows in FIG. 2 and other Figures indicate voltages or currents. The direction of these arrows was only chosen for convenience of explanation. A person of skill in the art is able to define currents and voltages in opposite senses. To have the following description applicable for different types of semiconductor devices (e.g., diodes, pnp-, npn-transistors), voltages across one or more pn-junctions (e.g., $V_{BE}$) are given in | | symbols for absolute values.

Currents $I_1$ and $I_2$ flow through bipolar transistors 216 and 226, respectively. Assuming different current densities $J_1$ in transistor 216 and $J_2$ in transistor 226, base-emitter voltages $|V_{BE\ 1}|$ and $|V_{BE\ 2}|$ are different and provide a voltage difference:

$$\Delta V=|V_{BE\ 1}|-|V_{BE\ 2}| \tag{1}$$

$\Delta V$ is applied to resistor 210 by voltage transfer units 260 and 270 at both terminals of resistor 210, respectively. Now, with $\Delta V$ being applied across resistor 210, a current $I_{R1}$ is generated:

$$I_{R1}=\Delta V/R_1 \tag{2}$$

with the slash for division. $I_{R1}$ does significantly not interfere with $I_1$ and $I_2$. Hence, bipolar transistors 216 and 226 do not carry the load current $I_{R1}$ of resistor 210.

Assuming, for simplicity a zero voltage drop across transfer unit 260, $V_{BE\ 1}$ of bipolar transistor 216 is applied across resistor 220. Similarly, a current $I_{R2}$ is generated:

$$I_{R2}=|V_{BE\ 1}|/R_2 \tag{3}$$

$I_{R2}$ is not significantly derived from $I_1$ or $I_2$. Current $I_{R2}$ and $I_{R2}$ are summed up in node 205 to reference current $I_M$ ("output current $I_M$"):

$$I_M=I_{R1}+I_{R2} \tag{4}$$

$$I_M=\Delta V/R_1+|V_{BE\ 1}|/R_2 \tag{5}$$

$$I_M = k*T/e_0*R_1*In(J_1/J_2)+|V_{BE\ 1}|R_2 \quad (6)$$

with k=1.38 * $10^{-23}$ Joule/Kelvin, $e_0$=1.60*$10^{-19}$ Coulomb, and T the actual operating temperature of circuit 200 in Kelvin. The term "k*T/$e_0$" is the temperature voltage $V_T$. At room temperature (T=300K), $V_T$ is around 26 mV (milli volts).

The first and the second term in equations (4) to (6) have temperature coefficients $TC_1$ and $TC_2$, respectively, which are, approximately related as $$|TC_1| \approx -|TC_2| \quad (7)$$

with $TC_1$=dT $I_{R1}$/dT and $TC_2$=dT $I_{R2}$/dT being deviations to the temperature T. A resulting temperature coefficient $TC_{total}$ of $I_M$ can be neglected and $I_M$ can be used as reference.

A preferred embodiment of the present invention will be explained in connection with FIGS. 3–5. The operation of the embodiment will be explained after having described the figures.

Figure 3:
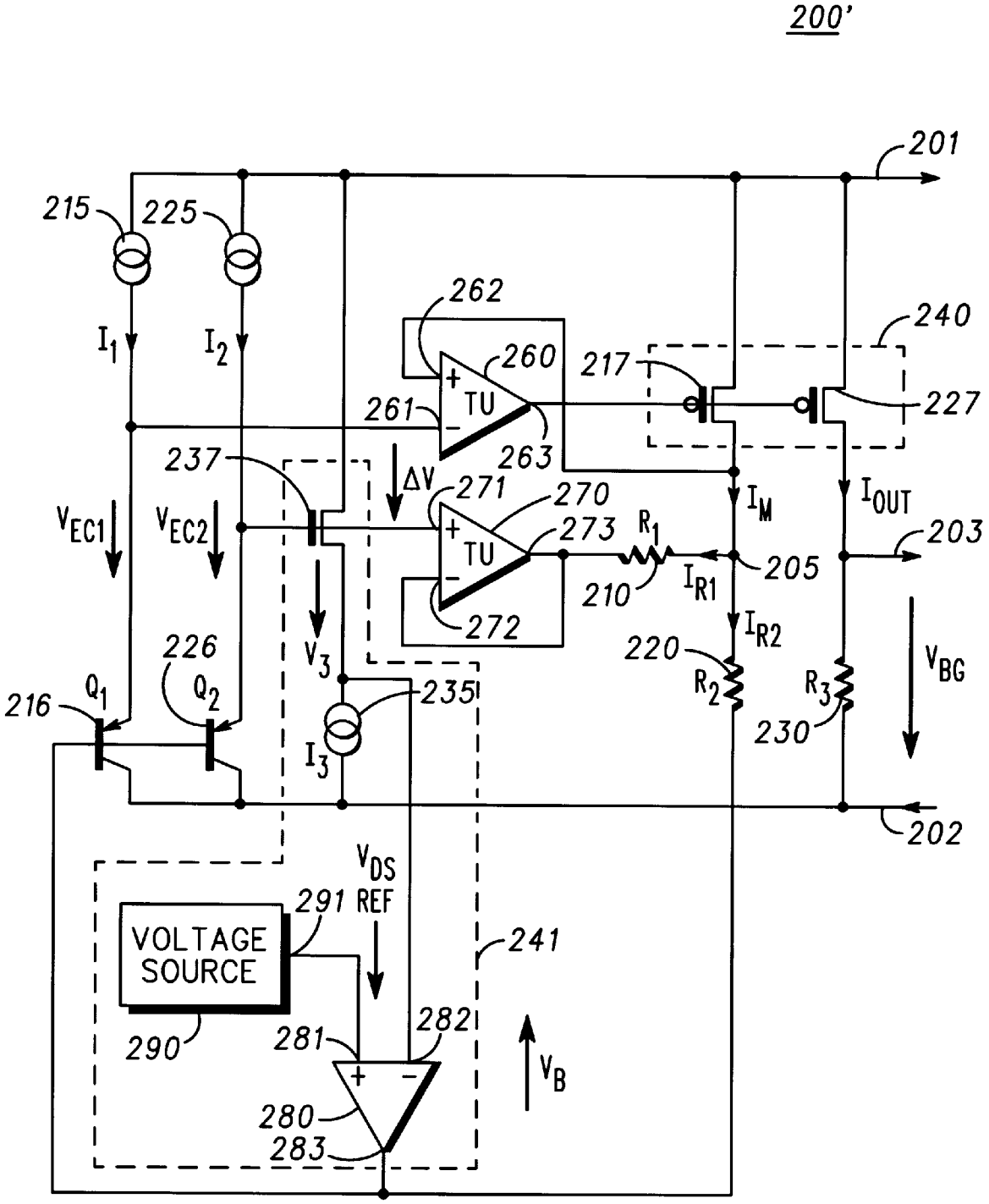
FIG. 3 is a simplified circuit diagram of the reference circuit of FIG. 2 in a preferred embodiment of the present invention.

FIG. 3 is a simplified circuit diagram of the reference circuit of FIG. 2 in a preferred embodiment of the present invention. Reference circuit 200' (hereinafter circuit 200') has supply lines 201 and 202 for receiving a supply voltage $V_{supply}$. Circuit 200' provides a reference voltage $V_{BG}$ ("BG" for "bandgap") preferably, at output line 203. Circuit 200' comprises current sources 215, 225 and 235, bipolar transistors 216 and 226, voltage transfer units 260 and 270 ("transfer units" or "op amps"), resistors 210, 220, and 230 having values $R_1$, $R_2$, and $R_3$, respectively, transistors 217, 227 and 237 (e.g., also "FETs"), comparator 280, node 205, and voltage source 290. Elements 205, 210, 215, 220, 225, 216, 226, 260, and 270 have already been introduced in connection with FIG. 2. Elements, such as transistor 237, current source 235, voltage source 290, and comparator 280 form control unit 241 (enclosed by dashed frame). Control unit 241 provides countermeasures to a common mode drift of ΔV. Transistors 217 and 227 have the function of a current mirror 240 (enclosed by dashed lines). Convenient implementations of transfer units 260 and 270 are illustrated by example in FIG. 4; and voltage source 290 is illustrated in FIG. 5.

Before explaining how the elements of circuit 200' are coupled, elements 215, 216, 217, 225, 226, 227, 237, 260, 270, and 280 are introduced. Current sources 215 and 225 can be implemented in may ways, for example, by resistors or transistor. Bipolar transistors 216 and 226 are, preferably, pnp-transistors having emitter electrodes ("emitters" or "E"), collector electrodes ("collectors" or "C") and base electrodes ("bases" or "B"). However, a person of skill in the art is able, based on the description herein, to use other components such as npn-transistors or diodes having pn-junctions. The term "bipolar transistor" as used here is intended to include any other device providing temperature dependent voltages.

Transfer units 260 and 270 are, preferably, operational amplifiers configured as voltage followers. But this is not essential. The term "transfer unit" is intended to include any device measuring a first voltage at a first node and providing a second voltage to a second node, wherein the second voltage is the first voltage multiplied with a gain factor. For simplicity of explanation, it is assumed that the gain factor is equal to 1, but other values can also be used. The second node at the transfer unit does not consume power from the first node. At transfer unit 260, input 261 is preferably an inverting input ("−") and input 262 is, preferably, a non-inverting input ("+"). At transfer unit 270, input 271 is, preferably, an non-inverting input ("+") and input 272 is, preferably, an inverting input ("−"). Comparator 280 is, preferably implemented as operational amplifier having non-inverting input 281 ("+") and inverting input 282 ("−")

Transistors 217 and 227 are, preferably, field effect transistors (FETs) of the p-channel type (p-FET). Transistor 237 is, preferably, a FET of the n-channel type (n-FET). To use p-FETs and n-FETS is convenient, but not essential. FETs have gate electrodes ("gates" or "G"), and drain and source electrodes ("D" and "S"). Which electrode is the drain D and which is the source S, depends on the applied voltages, so D and S are distinguished here only for the convenience of explanation. As it will be explained later in connection with FIG. 3, transistor 237 is preferably, of the same type (n or p) as FETs at inputs 261, 262, 271, and 272 of transfer units 260 and 270.

Current sources 215 and 225 are coupled between supply line 201 and emitters E of bipolar transistors 216 and 226, respectively. Collectors C of bipolar transistors 216 and 226 are coupled to supply line 202. Bases of transistors 216 and 226 are coupled together. Input 261 of transfer unit 260 is coupled to E of bipolar transistor 216; and input 271 of transfer unit 270 is coupled to E of bipolar transistor 226. Input 262 of transfer unit 260 is coupled to node 205. Output 263 of transfer gate 260 is coupled to gates G of FETs 217 and 227. Input 272 of transfer gate 270 is coupled to output 273 of transfer gate 270 which is coupled to resistor 210. Resistor 210 is further coupled to resistor 220 via node 205. Resistor 220 is further coupled to the bases of bipolar transistors 216 and 226. The source-drain (S-D) path of FET 217 is coupled between supply line 201 and node 205. FET 227 has its S coupled to supply line 201 and its D coupled to output line 203. Output line 203 is also coupled to supply line 202 via resistor 230. FET 237 has its D coupled to supply line 201 and its S coupled to current source 235 which is further coupled to supply line 202. The gate G of FET 237 is coupled to input 271 of transfer unit 270. Input 282 of comparator 280 is coupled to the S of FET 237. Input 281 of comparator 280 is coupled to output 291 of voltage source 290. Output 283 of comparator 280 is coupled to the bases B of bipolar transistors 216 and 226.

It is convenient to introduce voltages and currents. Voltage difference ΔV is measured between the Es of bipolar transistors 216 and 226, that is between input 261 of transfer unit 260 and input 271 of transfer unit 270. Currents $I_1$ and $I_2$ generated by current sources 215 and 225, respectively, flow by definition into the Es of transistors 216 and 226, respectively. Current $I_M$ comes from p-FET 217 and is split at node 205 into current $I_{R1}$ through resistor 210 and into current $I_{R2}$ through resistor 220. A current between node 205 and input 262 is neglected. Mirror current $I_{out}$ originating by mirroring $I_M$ in current mirror 240 flows through transistor 227 and resistor 230. Output voltage (or reference voltage) $V_{BG}$ is defined across resistor 230 between output line 203 and supply line 202. Voltage $V_3$ is the voltage at the source S of n-FET 237 referred to line 202 and also applied to input 282 of comparator 280. $V_{DS\ REF}$ is provided by voltage source 290 at its output 291 and available at input 281 of comparator 280. $V_B$ ("B" for "base") is the base voltage of bipolar transistors 216 and 226 referred to line 202. Voltages at emitters E of bipolar transistors 216 and 226 referred to supply line 202 (here, coupled to collectors C) are $|V_{EC\ 1}|$ and $|V_{EC\ 2}|$ or, in general $|V_{EC}|$ $|V_{EC\ 1}|$ and $|V_{EC\ 2}|$ are also present at inputs 261 and 271, respectively.

Figure 4:
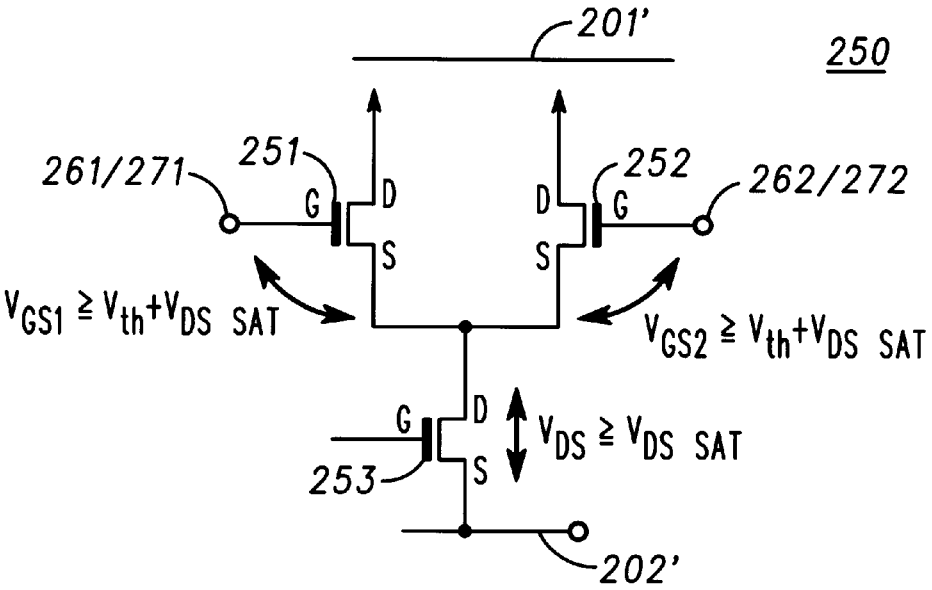
FIG. 4 is a simplified circuit diagram of an input stage used in the reference circuit of FIG. 3.

FIG. 4 is a simplified circuit diagram of input stage 250 conveniently used in transfer units 260 and 270 of circuit 200' of FIG. 3. Input stage 250 comprises n-FETs 251, 252, and 253. As illustrated by lines 201' and 202' with primed reference numbers, input stage 250 is, preferably, coupled to supply lines 201 and 202 of FIG. 3. It is not essential, but understood by those of skill in the art, that other components can eventually be coupled between lines 201'/201 and 202'/202. As illustrated by arrows pointing to line 201', drains D of n-FETs 251 and 252 provide currents to subsequent stages of transfer unit 260 and 270. The sources S are coupled together to the drain D of n-FET 253. The source S of n-FET 253 is coupled to line 202'. Gate G of n-FET 251 is input 261 or input 271; and G of n-FET 252 is input 262 or input 272. G of n-FET 253 receives a bias voltage which is not essential to be Preferably, and left out for simplicity.

Preferably, n-FETs 251, 252, and 253 should operate in the saturation region ("active region"). Therefore, the gate-source voltages $V_{GS\ 1}$ of n-FET 251 and $V_{GS\ 2}$ of n-FET 252 are larger or substantially equal than the sum of threshold voltage $V_{th}$ and the drain-source saturation voltage $V_{DS\ SAT}$ of n-FETs:

$$V_{GS\ 1} \geqq V_{th} + V_{DS\ SAT} \text{ and} \tag{8}$$

$$V_{GS\ 2} \geqq V_{th} + V_{DS\ SAT}. \tag{9}$$

By biasing n-FET 253, its drain-source voltage $V_{DS\ 3}$ is larger or substantially equal to the drain-source saturation voltage $$V_{DS\ 3} \geqq V_{DS\ SAT} \tag{10}$$

The input voltages of transfer units 260 and 270 at their inputs 261, 262, 271, and 272 are the emitter—collector voltages $|V_{EC\ 1}|$ and $|V_{EC\ 2}|$ across bipolar transistors 216 and 226. Here, $|V_{EC}|$ are:

$$|V_{EC}| \geqq 2*V_{DS\ SAT} + V_{th} \tag{11}$$

(twice saturation voltage and threshold voltage). The saturation voltage $V_{DS\ SAT}$ depends on the temperature. Therefore, it must be adjusted when the temperature changes. This is accomplished in the circuit of FIG. 5.

Figure 5:
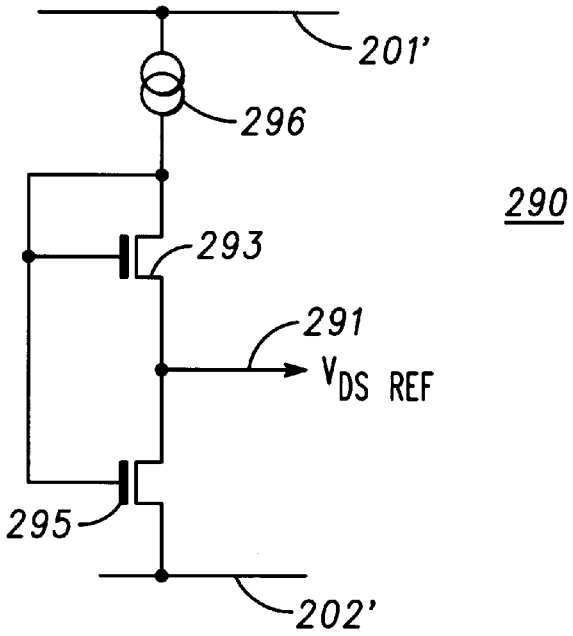
FIG. 5 is a simplified circuit diagram of a voltage source used in the reference circuit of FIG. 3.

FIG. 5 is a simplified circuit diagram of voltage source 290 used in the reference circuit 200' of FIG. 3. Voltage source 290 provides a voltage $V_{DS\ REF}$ at output 291. $V_{DS\ REF}$ (FIG. 5) and $V_{DS\ SAT}$ (see FIG. 4) depend on the temperature T and on a manufacturing process in the same way. Preferably, voltage source 290 comprises current source 296 and n-FETs 293 and 295 serially coupled between lines 201' and 202' (see FIG. 4). In detail, current source is coupled to line 201' and to the drain D of n-FET 293; the source S of n-FET 293 is coupled to the drain D of n-FET 295 at output 291; and the source S of n-FET 295 is coupled to line 202'. Gates G of n-FETs 293 and 295 are coupled together to D of n-FET 293. A person of skill in the art is able to provide a similar voltage source by other components and, based on the description herein, to use the voltage source in the same or similar function within circuit 200.

As it will be explained later, $V_{DS\ REF}$ is used to control the common base voltage $|V_B|$ (see FIG. 3) of bipolar transistors 216 and 226. This voltage $|V_B|$ influences the voltage $|V_{EC}|$ at n-FETs 251 and 252 of input stages 260 and 270. It is an important feature of the embodiment of the present invention, that $V_{DS\ REF}$ is derived from the parameters of the FETs and not derived from bipolar transistors.

Circuits 200 (FIG. 2) and circuit 200' provide reference current $I_M$, which is substantially independent from temperature changes. Current sources 215 and 225, bipolar transistors 216 and 226, transfer units 260 and 270, resistors 210 and 220 operates as described in connection with FIG. 2.

Current mirror 240 transfers reference current $I_M$ to $I_{out}$ through resistor 230. The output voltage $V_{BG}=I_{out}*R_3$ across resistor 230 at output line 203 does not significantly influence reference current $I_M$.

Voltage differences $\Delta V$ and $|V_{BE}|$ are subject to temperature changes. Also, input voltages $V_{EC\ 1}$ and $V_{EC\ 2}$ at transfer units 260 and 270 should depend on the threshold voltages $V_{th}$ of e.g., transistor 237 and the transistors within transfer units 260 and 270 (such as e.g., transistors 251 and 252). Hence, common mode drift of $\Delta V$ acts on input stages 250 of transfer units 260 and 270 which require certain input voltages (e.g., $|V_{EC}| \geqq 2*V_{DS\ SAT}+V_{th}$). The voltage drift expresses itself by, for example, a simultaneous increase or decrease of $|V_{BE\ 1}|$ and $|V_{BE\ 2}|$. Control unit 241 (transistor 237, current source 235, voltage source 290 and comparator 280) compensates common mode drift according to a method of the present invention with the following steps: measuring a first voltage ($|V_{EC\ 1}|$ or $|V_{EC\ 2}|$) at one electrode (e.g., E of 226) of one of bipolar transistors 216 or 226; linearly converting (e.g., by current source 235 and n-FET 237) the first voltage ($|V_{EC\ 1}|$ or $|V_{EC\ 2}|$) to a second voltage $V_3$ which does not significantly influence the first voltage ($|V_{EC\ 1}|$ or $|V_{EC\ 2}|$); providing a reference voltage (e.g., $V_{DS\ REF}$ by voltage source 290) which is related to the required input voltage (e.g., $\geqq 2*V_{DS\ SAT}+V_{th}$); and comparing the second voltage (e.g., $V_3$) to the reference voltage (e.g., $V_{DS\ REF}$) and changing the common voltage (e.g., $|V_B|$) which controls bipolar transistors 216 and 226.

In other words, control unit 241 shifts base-emitter voltages $|V_{BE\ 1}|$ and $|V_{BE\ 2}|$ without changing their values so that the input voltage at voltage transfer units 260 and 270 is substantially more than a saturation voltage $V_{DS\ SAT}$ and a threshold voltage $V_{th}$ of n-FETs so that the FETs operate in a saturation region.

It is an advantage of the present invention that in the step of providing the reference voltage, the reference voltage is derived from the threshold voltage $V_{th}$ of field effect transistors (e.g., n-FETs 293 and 295 of voltage source 290).

It is a further advantage of the present invention that the supply voltage $V_{supply}$ can be as low as 0.7 volts to 0.8 volts. Spikes, for example, common mode signals coupled through the bipolar transistors (or otherwise) do not significantly influence the reference voltage $V_{BG}$.

When comparing a reference circuit of the present invention to prior art solutions, the following advantages of the present invention are apparent: (a) Resistors (such as $R_1$ and $R_2$) are located at the outputs of operational amplifiers. The bipolar transistors are de-coupled from the resistors and carry lower current loads. (b) The bipolar transistors can be implemented with smaller dimensions, thus saving chip space and, due to smaller capacitances, substantially preventing spikes from penetrating. (c) The supply voltage can be reduced to e.g., 0.7–0.8 volts. (d) The reference circuit can be used for modern low-voltage applications (e.g., CMOS circuits).

It will be appreciated that although only one particular embodiment of the invention has been described in detail, various modifications and improvements can be made by a person skilled in the art based on the teachings herein without departing from the scope of the present invention. Accordingly, it is the intention to include such modifications as will occur to those of skill in the art in the claims that follow.

We claim:

1. A reference circuit comprising:

a first transistor with a first current $I_1$ and a first current density $J_1$, providing a first base-emitter voltage $|V_{BE\ 1}|$;

a second transistor with a second current $I_2$ and a second current density $J_2$, providing a second base-emitter voltage $|V_{BE\ 2}|$;

a first voltage transfer unit coupled to said first transistor;

a second voltage transfer unit coupled to said second transistor;

a first resistor having value $R_1$ coupled to said first transistor by said first voltage transfer unit and to said second transistor by said second voltage transfer unit so that a third current $I_{R1}=(|V_{BE\ 1}|-|V_{BE\ 2}|)/R_1$ flows through said first resistor without substantially being derived from said first current $I_1$ or from said second current $I_2$; and a second resistor having value $R_2$ coupled to said first transistor by said first voltage transfer unit so that a fourth current $I_{R2}$ flows through said second resistor without substantially being derived from said first current $I_1$, in said reference circuit, said third current $I_{R1}$ and said fourth current $I_{R2}$ being added and provided as reference current $I_M$.

2. The reference circuit of claim 1 wherein said values $R_1$, $R_2$, $J_1$, and $J_2$ being selected in such a way that third current $I_{R1}$ and said fourth current $I_{R2}$ have substantially equal, but inverted temperature coefficients:

$$dT\ I_{R1}/dT \approx -dT\ I_{R2}/dT.$$

3. The reference circuit of claim 1 further comprising a current mirror and a third resistor having value $R_3$ wherein said reference current $I_M$ is mirrored to said third resistor so that an output voltage is available across said third resistor, said output voltage substantially not influencing said reference current $I_M$.

4. The reference circuit of claim 1 wherein said first resistor and said second resistor are not connected to said first transistor and said second transistor.

5. The reference circuit of claim 1 wherein said first voltage transfer unit and said second voltage transfer unit are operational amplifiers with input stages comprising n-channel field effect transistors (n-FETs), said n-FETs being are coupled to said first transistor and to said second transistor, respectively.

6. The reference circuit of claim 1 wherein said first voltage transfer unit and said second voltage transfer unit both comprise n-channel field effect transistors (n-FETs) coupled to said first transistor and to said second transistor by gate electrodes, respectively, said n-FETs operating in an active region with $$V_{GS}>V_{th}+V_{DS\ SAT}$$

with $V_{GS}$ being gate-source voltages, $V_{th}$ being a threshold voltage, and $V_{DS\ SAT}$ being a saturation voltage.

7. The reference circuit of claim 1 wherein said first transistor and said second transistor are bipolar transistors.

8. The reference circuit of claim 1 wherein said first transistor and said second transistor are bipolar transistors of the pnp-type having base electrodes coupled together to said second resistor.

9. The reference circuit of claim 1 wherein said first and second voltage transfer units have input stages with n-channel field effect transistors (n-FETs), and wherein at least one of said first or second voltage transfer units receives a control voltage which is substantially equal to a saturation voltage $V_{DS\ SAT}$ of said n-FETs.

10. The reference circuit of claim 1 wherein said first and second voltage transfer units comprise n-channel field effect transistors (n-FETs) and wherein said reference circuit further comprises a control unit coupled to one of said first and second voltage transfer units and to said first and second transistors, said control unit shifting said first and second base-emitter voltage $|V_{BE\ 1}|$ and $|V_{BE\ 2}|$ without changing their values so that the input voltage at said first and second voltage transfer units is substantially more than a saturation voltage $V_{DS\ SAT}$ and a threshold voltage $V_{th}$ of n-FETs so that said FETs operate in a saturation region.

11. A reference circuit comprising a first bipolar transistor and a second bipolar transistor providing a voltage difference $\Delta V$ of base-emitter voltages $|V_{BE}|$; a first resistor and a second resistor for adding a first current $I_{R1}$ resulting from said voltage difference $\Delta V$ to a second current $I_{R2}$ resulting from the base-emitter voltage $|V_{BE}|$ of one of said first or second bipolar transistors so that a resulting temperature coefficient of said first and second currents $I_{R1}$, $I_{R2}$ is compensated; and voltage transfer units for transferring said $\Delta V$ to said first and second resistors so that said resistors do not substantially load said first and second transistors.

12. The reference circuit of claim 11 further comprising a control unit measuring a $V_{DS\ SAT}$ saturation voltage of field effect transistors (FETs) for an actual operating temperature T of said reference circuit and shifting the base-emitter potentials of said first and second bipolar transistors to a level which is higher than $V_{DS\ SAT}$.

13. A reference circuit having bipolar transistors for providing voltages with opposite temperature coefficients which are compensated, characterized in that said reference circuit further comprises:

field effect transistors (FETs) to provide a first reference voltage from the threshold voltage of said FETs, a further transistor controlled by one of said bipolar transistors to provide a second reference voltage, a comparator receiving said first reference voltage at a non-inverting input and receiving said second reference voltage at an inverting input to supply a bias voltage $V_{BIAS}$ to base electrodes of said bipolar transistors.

14. A reference circuit having a first supply line and a second supply line and providing a substantially temperature invariant reference, said reference circuit comprising:

a first current source and a second current source, each being coupled to said first supply line;

a first bipolar transistor and a second bipolar transistor, each having an emitter electrode and a collector electrode coupled between said first supply line and said second supply line, said first bipolar transistor and said second bipolar transistor having base electrodes coupled together;

a first operational amplifier (op amp) and a second operational amplifier (op amp), said first op amp having a first input coupled to the emitter electrode of said first transistor, said second op amp having a first input coupled to the emitter electrode of said second transistor, said second op amp being configured as a follower having an output coupled to a second input of said second op amp;

a first resistor coupled between a second input of said first op amp forming a first node and an output of said second op amp, said first resistor having thereby a first voltage difference between base-emitter voltages of said first bipolar transistor and said second bipolar transistor; and a second resistor coupled between said second input of said first op amp and the base electrodes of said first transistor and of said second transistor, said second resistor having thereby a second voltage difference which is a base-emitter voltage of said first bipolar transistor, wherein said first voltage difference and said second voltage difference provide currents through said second resistor having different temperature coefficients so that the resulting current is substantially temperature invariant reference.

15. The circuit of claim 14 further comprising:

a current mirror coupled to said first node and receiving said resulting current and providing a mirror current; and a third resistor receiving said mirror current and providing a reference voltage to an output line.

16. The circuit of claim 14 wherein said first bipolar transistor and said second bipolar transistor are pnp-transistors.

17. The circuit of claim 14 with said first input of said first op amp being an inverting input;

said second input of said first op amp being an non-inverting input;

said first input of said second op amp being an non-inverting input; and said second input of said second op amp being an inverting input.

18. The circuit of claim 14 further comprising:

and a third resistor; and a first p-FET and a second p-FET forming a current mirror for transferring said resulting current to said third resistor so that said reference is available as reference voltage at an output line.

19. The circuit of claim 14 further comprising:

a field effect transistor and a third current source serially coupled between said first supply line and said second supply line, a gate of said field effect transistor being coupled to either of said first inputs of said first and second op amps.

20. In a reference circuit in which bipolar transistors controlled by a common voltage provide a voltage difference $\Delta V$ wherein said bipolar transistors are coupled to voltage transfer units having input stages requiring certain input voltages, a method for compensating common mode drifts of $\Delta V$ due to temperature changes, said method comprising the steps of:

measuring a first voltage at one electrode of one of said bipolar transistor;

linearly converting said first voltage to a second voltage which does not significantly influence said first voltage;

providing a reference voltage by a voltage source which is related to said required input voltage; and comparing said second voltage to said reference voltage and changing said common voltage which controls said bipolar transistors.

21. The method of claim 20 wherein in said step of providing a reference voltage, said reference voltage is derived from threshold voltages of field effect transistors.

* * * * *